US005771504A

United States Patent [19]

Steiner

[11] Patent Number: 5,771,504

[45] Date of Patent: Jun. 30, 1998

[54] SHOWER CURTAIN RIBS

[76] Inventor: Merill R. Steiner, 304 French Rd., Newtown Square, Pa. 19073

[21] Appl. No.: 678,107

[22] Filed: Jul. 11, 1996

[51] Int. Cl.[6] ..... A47K 3/14

[52] U.S. Cl. ..... 4/558; 4/608; 4/610; 160/DIG. 6

[58] Field of Search ..... 4/607, 608, 610, 4/558, 557, 609; 160/DIG. 6, 330, 352

[56] References Cited

U.S. PATENT DOCUMENTS

| | | | |
|---|---|---|---|
| 2,120,155 | 6/1938 | Shera | 4/608 |
| 2,776,439 | 1/1957 | Rondinelli | 4/608 |
| 3,321,781 | 5/1967 | Reich | 4/608 |
| 3,382,507 | 5/1968 | Micheau | 4/558 |
| 3,500,481 | 3/1970 | McKwane | 4/558 |
| 3,808,610 | 5/1974 | Mortensen | 4/558 |
| 5,007,120 | 4/1991 | Annand | 4/558 |
| 5,097,541 | 3/1992 | Annand | 4/558 |

*Primary Examiner*—Charles R. Eloshway
*Attorney, Agent, or Firm*—Lipton, Weinberger & Husick; Robert S. Lipton, Esq.

[57] ABSTRACT

An apparatus for use with a conventional bathtub shower curtain which prevents the curtain from being drawn into the shower enclosure when the shower is in use. The apparatus has a plurality of semi-rigid ribs which are vertically oriented and connected to the shower curtain rod. The lower end of the ribs are secured to the tub and the outer surface of the curtain is secured to the ribs thus preventing the curtain from moving inward. By securing the ribs so that they bow outward the shower enclosure can be enlarged.

11 Claims, 11 Drawing Sheets

SHOWER CURTAIN RIBS

BACKGROUND OF THE INVENTION

1. Field of the Invention

The present invention generally relates to an apparatus for the purpose of creating a more open and pleasing space inside a shower curtain. In particular, the present invention relates to a plurality of semi-rigid shower curtain ribs for use with a shower curtain. The shower curtain is capable of effectively closing off a shower enclosure to contain a shower spray within the enclosure. An upper periphery is provided with a curtain rod from which the shower curtain is suspended, and a lower periphery within which said shower curtain is intended to remain. Description of Related Art 2. Description of Related Art In the United States it has been common for a number of years for people to bathe in the spray of an overhead shower, rather than immersed in a tub of water. Most modern homes have shower facilities installed and, while many of these have glass shower doors to prevent water from spraying out into the bathroom, a large number of these are provided with a curtain of fabric or plastic which is drawn across the entrance for the same purpose.

One of the inconveniences of such a curtain, however, is that it will move with moving air. A partial vacuum created by a warm water spray within a shower enclosure will draw air, and the curtain, into the shower enclosure. This limits the available room and is inconvenient to the user.

A number of methods have been employed to prevent this movement of the shower curtain, including weights or magnets attached to the bottom of the curtain, which tend to hold the curtain straight down but restrict its movement when one enters or leaves the shower enclosure. Other, more elaborate, solutions have been proposed to provide shower curtains for bathtubs and control the movement of the shower curtain, as well.

U.S. Pat. No. 1,159,507 to Lang is entitled SHOWER BATH CURTAIN. This reference shows vertical ribs for supporting a shower curtain which have inverted U-shaped members at their lower periphery which engage the side of a tub. These ribs, however, create a structure for supporting the shower curtain, and the curtain is not suspended from a curtain rod. There is no teaching that the ribs are intended to prevent the curtain from billowing inward in use.

U.S. Pat. No. 1,255,396 to Eaton is entitled CURTAINED SPRAY AND SHOWER BATH. This reference shows an apparatus with an inverted U-shaped structure intended to engage the side of a tub and provide support for a shower curtain. There is no teaching that the device is intended to prevent the curtain from billowing inward in use.

U.S. Pat. No. 2,092,426 to Riddell is entitled BATH FIXTURE. This reference shows a single structural apparatus having an inverted U-shaped lower terminus, which attaches to a tub and shower curtain rod, and is also attached to a shower curtain. While the purpose of the apparatus is partly to assist in the proper position of the shower curtain, it is also intended to provide a solid structure as a safety handhold when one gets into and out of a wet tub.

U.S. Pat. No. 2,725,576 to Schwersinske is entitled SPLASH SHIELD FOR SHOWER AND BATHTUBS. This reference shows an apparatus for attachment to the side of a tub enclosure in which the attachment means is a plurality of inverted U-shaped members. The apparatus, however, does not cooperate with, or relate to the operation of, the shower curtain.

U.S. Pat. No. 2,776,439 to Rondinelli is entitled SHOWER BATH CURTAINS. This reference shows a solution to the problem of a shower curtain billowing into a tub enclosure. However, the solution shown by this reference employs an inward facing apron attached to the shower curtain and which engages the inside of the tub. The main portion of the shower curtain extends downward on the outside of the tub, thus preventing the shower curtain from being drawn into the tub enclosure.

U.S. Pat. No. 3,382,507 to Micheau is entitled CURTAIN POSITION-RETAINING MEANS. This reference shows a means for preventing a shower curtain from being drawn into the shower when the shower is in use. The means of this reference are positioned on the inward side of the shower curtain and push it outward so that it abuts the edge of the tub. In particular, the means of this reference uses a plurality of ribs positioned on the inside of the shower curtain to prevent the shower curtain from billowing inward. The ribs of the reference are secured to the inside wall of the tub enclosure by magnets.

U.S. Pat. No. 3,808,610 to Mortensen is entitled SHOWER CURTAIN GUARD DEVICE. This reference shows a single structural apparatus for preventing water from escaping outside a tub enclosure. The device is employed to secure an end of the shower curtain, at the shower end of the tub enclosure, to the wall, thereby preventing water from escaping through a gap which might otherwise be there.

U.S. Pat. No. 5,007,120 to Annand is entitled SHOWER CURTAIN LINER CONTROL DEVICE. This reference shows a means for preventing a shower curtain from being drawn into the shower when the shower is in use. The means of this reference are positioned on the inward side of the shower curtain and push the curtain outward so that it abuts the edge of the tub. In particular, the means of the reference push the midportion of the curtain outward beyond the edge of the tub to create more room for the person taking the shower.

SUMMARY OF THE INVENTION

It is an object of the present invention to provide an economical and practical way to create a more pleasing open space inside the shower curtain in the area above a bathtub that has a shower and shower curtain and to maintain that open space during a shower.

It is a further object of the present invention to permit, during a shower, the shower curtain to continue to serve a primary purpose of preventing water from escaping from the shower area to the area of the bathroom outside the bathtub and shower curtain.

It is a still further object of the present invention to allow the shower curtain to be opened and closed easily and simply, to facilitate both the taking of showers and the cleaning of the bathtub and shower area.

The other objects, features and advantages of the present invention will become more apparent in light of the following detailed description of the preferred embodiment thereof.

Accordingly, it is an abject of the present invention to provide a plurality of semi-rigid shower curtain ribs for use with a shower curtain, which shower curtain is capable of effectively closing off a shower enclosure to contain a shower spray within said shower enclosure, said opening having an upper periphery provided with a curtain rod from which said shower curtain is suspended, and a lower periphery within which said shower curtain is intended to remain, said shower curtain ribs positioned external to said shower enclosure with respect to said shower curtain, and comprising: means for suspension of said ribs from said shower curtain rod at the upper periphery of said opening; means to operatively engage said lower periphery of said opening; and, attachment means to operatively engage said shower curtain and prevent movement of said shower curtain inward from said ribs into said shower enclosure.

BRIEF DESCRIPTION OF THE DRAWINGS

FIGS. 1O*a–d* show alternative embodiments of the present invention employed with circular tub designs.

DETAILED DESCRIPTION OF THE PREFERRED EMBODIMENT

Figure 1:
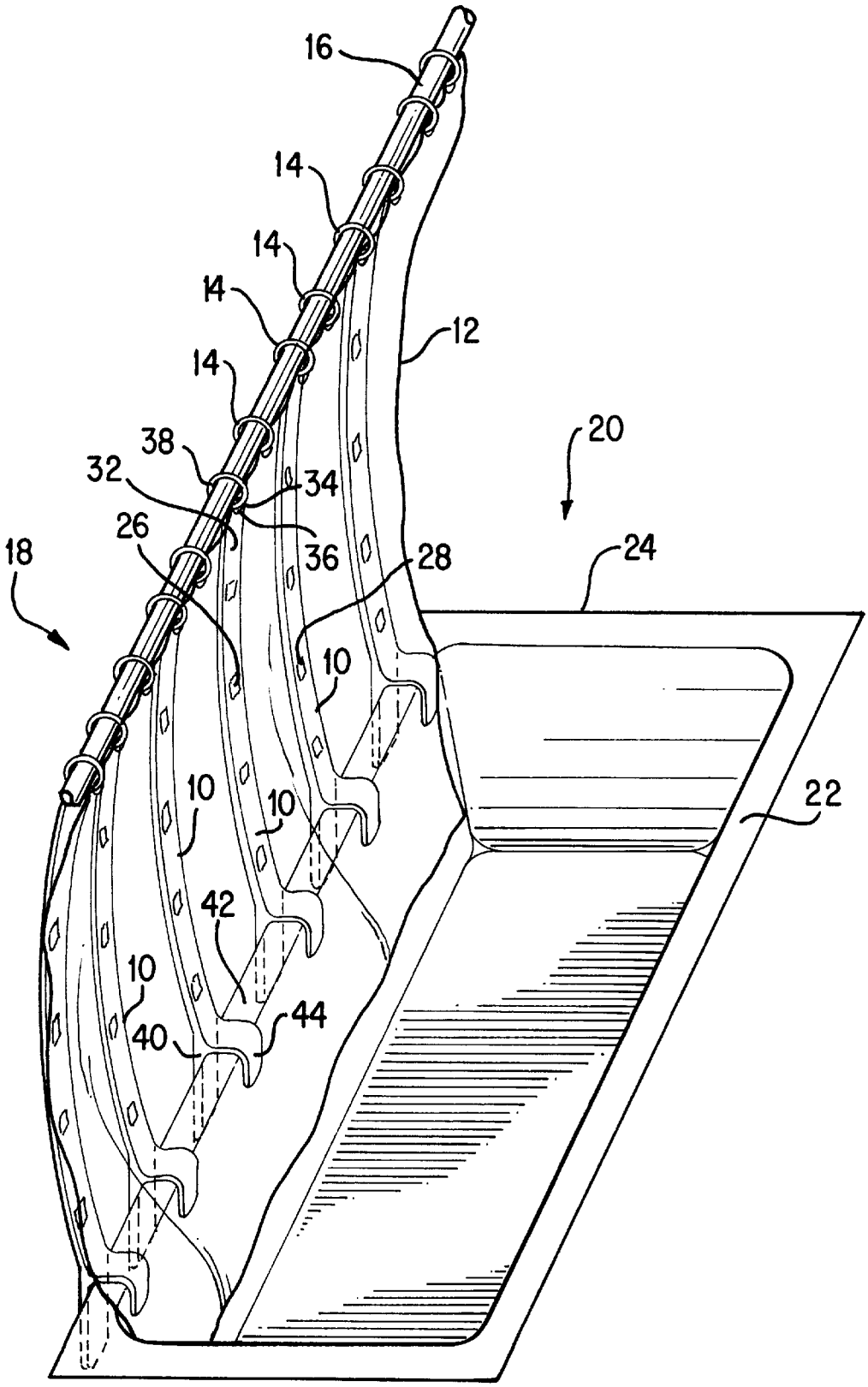
FIG. 1 shows a perspective view of a typical shower arrangement installed in a bathtub, with a plurality of shower curtain ribs of the present invention.

As noted previously, it has been common for a number of years for people in the United States to bathe in the spray of an overhead shower, rather than immersed in a tub of water. Most modern homes have shower facilities installed and, while many of these have glass shower doors to prevent water from spraying out into the bathroom, a large number of these are provided with a curtain of fabric or plastic which is drawn across the entrance for the same purpose.

One of the inconveniences of such a curtain, however, is that it will move with moving air. A partial vacuum created by a warm water spray within a shower enclosure will draw air, and the curtain, into the shower enclosure. This limits the available room and is inconvenient to the user.

A number of methods have been employed to prevent this movement of the shower curtain, including weights or magnets attached to the bottom of the curtain, which tend to hold the curtain straight down but restrict its movement when one enters or leaves the shower enclosure. Other, more elaborate, solutions have been proposed in the past to provide shower curtains for bathtubs and control the movement of the shower curtain, as well.

In the present invention there is shown a plurality of semi-rigid shower curtain ribs for use with a shower curtain, which shower curtain is capable of effectively closing off an opening of a shower enclosure to contain a shower spray within said shower enclosure, said opening having an upper periphery provided with a curtain rod from which said shower curtain is suspended, and a lower periphery within which said shower curtain is intended to remain, said shower curtain ribs positioned external to said shower enclosure with respect to said shower curtain, and comprising:

means for suspension of said ribs from said shower curtain rod at the upper periphery of said opening;

means to operatively engage said lower periphery of said opening; and, attachment means to operatively engage said shower curtain and prevent movement of said shower curtain inward from said ribs into said shower enclosure.

In a preferred embodiment of the present invention, there is shown an apparatus for the creation and maintenance of a larger open space inside a shower enclosure having a shower curtain. In a first preferred embodiment, this apparatus comprises:

i) a shower enclosure of generally box-like configuration with an upper periphery which may be open and a closed lower periphery, said enclosure having:

at least one raised shower head located near the upper periphery of said enclosure, said shower head capable of providing a spray of water within said shower enclosure;

a base at the lower periphery of said shower enclosure for the purpose of collecting and draining away water from said shower head; and, at least one open area for entrance and egress by a user, said open area defined, at least in part, by an upper periphery of said base;

ii) a curtain rod positioned near the upper periphery of said shower enclosure in the region of said open area and provided with a first curtain rod attachment means from which a shower curtain may be suspended;

iii) a shower curtain of flexible material suspended from said curtain rod by said first curtain rod attachment means and capable of effectively closing off said open area to contain said spray of water within said shower enclosure;

iv) a plurality of semi-rigid shower curtain ribs positioned external to said shower enclosure with respect to said shower curtain, and descending vertically from said curtain rod to a point beyond the upper periphery of said base defining said open area, each of said ribs having:

a second curtain rod attachment means at its upper periphery, said second curtain rod attachment means engagedly attached to said curtain rod;

an inverted U-shaped fork of two tines at its lower terminal end, which fork engages said upper periphery of said base with one tine of said fork within said shower enclosure and the other tine of said fork outside said shower enclosure;

first curtain attachment means joining said shower curtain to said rib at at least one point along the vertical length of said rib, and preventing movement of said shower curtain inward from said rib into said shower enclosure.

Such an embodiment may be used in a typical bathtub or shower stall arrangement with little or no modification to the facility. As such it will prevent the inward movement of the shower curtain and provide a pleasing open space within the shower enclosure.

In a second preferred embodiment, this apparatus comprises:

i) a shower enclosure of generally box-like configuration with an upper periphery which may be open and a closed lower periphery, said enclosure having:

at least one raised shower head located near the upper periphery of said enclosure, said shower head capable of providing a spray of water within said shower enclosure;

a base at the lower periphery of said shower enclosure for the purpose of collecting and draining away water from said shower head; and, at least one open area for entrance and egress by a user, said open area defined, at least in part, by an upper periphery of said base;

ii) a first curtain rod positioned near the upper periphery of said shower enclosure in the region of said open area and provided with a first curtain rod attachment means from which a shower curtain may be suspended;

iii) a second curtain rod positioned near the lower periphery of said shower enclosure in the region of said open area and proximate to the upper periphery of said base;

iv) a shower curtain of flexible material suspended from said first curtain rod by said first curtain rod attachment means and capable of effectively closing off said open area to contain said spray of water within said shower enclosure;

v) a plurality of semi-rigid shower curtain ribs positioned external to said shower enclosure with respect to said shower curtain, and descending vertically from said first curtain rod to said second curtain rod, each of said ribs having:

a second curtain rod attachment means at its upper periphery, said second curtain rod attachment means engagedly attached to said first curtain rod;

a third curtain rod attachment means at its lower periphery, said third curtain rod attachment means engagedly attached to said second curtain rod;

first curtain attachment means joining said shower curtain to said rib at at least one point along the vertical length of said rib, and preventing movement of said shower curtain inward away from said rib into said shower enclosure.

Such an embodiment may be used in a typical bathtub or shower stall arrangement with slight modification, that is, the bathtub or shower stall would have to be provided with a second curtain rod at the lower portion of the access opening. With such limited modification, however, the device will prevent the inward movement of the shower curtain and provide a pleasing open space within the shower enclosure.

In a third preferred embodiment, this apparatus comprises:

i) a shower enclosure of generally box-like configuration with an upper periphery which may be open and a closed lower periphery, said enclosure having:

at least one raised shower head located near the upper periphery of said enclosure, said shower head capable of providing a spray of water within said shower enclosure;

a base at the lower periphery of said shower enclosure for the purpose of collecting and draining away water from said shower head; and, at least one open area for entrance and egress by a user, said open area defined, at least in part, by an upper periphery of said base;

ii) a curtain rod positioned near the upper periphery of said shower enclosure in the region of said open area and provided with a first curtain rod attachment means from which a shower curtain may be suspended;

iii) a shower curtain of flexible material suspended from said curtain rod by said first curtain rod attachment means and capable of effectively closing off said open area to contain said spray of water within said shower enclosure;

iv) a plurality of semi-rigid shower curtain ribs positioned external to said shower enclosure with respect to said shower curtain, and descending vertically from said curtain rod to a point proximate to the upper periphery of said base defining said open area, each of said ribs having:

a second curtain rod attachment means at its upper periphery, said second curtain rod attachment means engagedly attached to said curtain rod;

stabilizing means at its lower terminal end, which stabilizing means engages said upper periphery of said base and positions said ribs relative thereto;

first curtain attachment means joining said shower curtain to said rib at at least one point along the vertical length of said rib, and preventing movement of said shower curtain inward from said rib into said shower enclosure.

As illustrated in the FIGS. 1 to 11, attached, the present invention consists of bowed ribs 10, which may suitably be made of plastic, metal or wood, that are hung with the shower curtain 12, depicted as transparent in FIG. 1. These ribs 10 may be suspended from the typical shower curtain hooks 14 which are available commercially, and may be combined with the shower curtain 12 itself, or suspended separately from dedicated hooks that are mounted on a typical shower curtain rod 16 attached in the usual place above the opening 18 to a bathtub/shower area 20 or open shower stall.

The ribs 10 are intended to bow outward from the showering area 20 that is either above the bathtub 22 of the bathtub/shower 24 or shower stall floor 53, and this bowing can be accomplished in the fabrication of the ribs 10, or the bowing can be effected by having the length of the rib 10 longer than the opening 18 in which it is positioned, with flexibility of the rib 10 bowing it outward.

As illustrated in FIG. 1, the shower curtain 12 is positioned inside the ribs 10 and attached to the ribs 10 so that the bowing of the ribs 10 holds the shower curtain 12 out away from the showering area 20 when the shower curtain 12 is closed. The ribs 10 may be made with various degrees of bowing so that the customer can select as great or as little bowing as desired with less bowing designed for bathrooms where space is limited so that the bowing does not get in the way when the shower curtain 12 is in the opened or closed position.

In use, a second decorative, shower curtain may be hung in the usual fashion on the same hooks with the inner, plastic curtain 12 and the ribs 10, if desired. This second, decorative shower curtain would be positioned on the outside of the ribs 10, so that the ribs 10 are covered on the outside by the second, decorative curtain and on the inside by the inner, plastic shower curtain 12.

Attachment of Shower Curtain to Ribs

Figure 2:
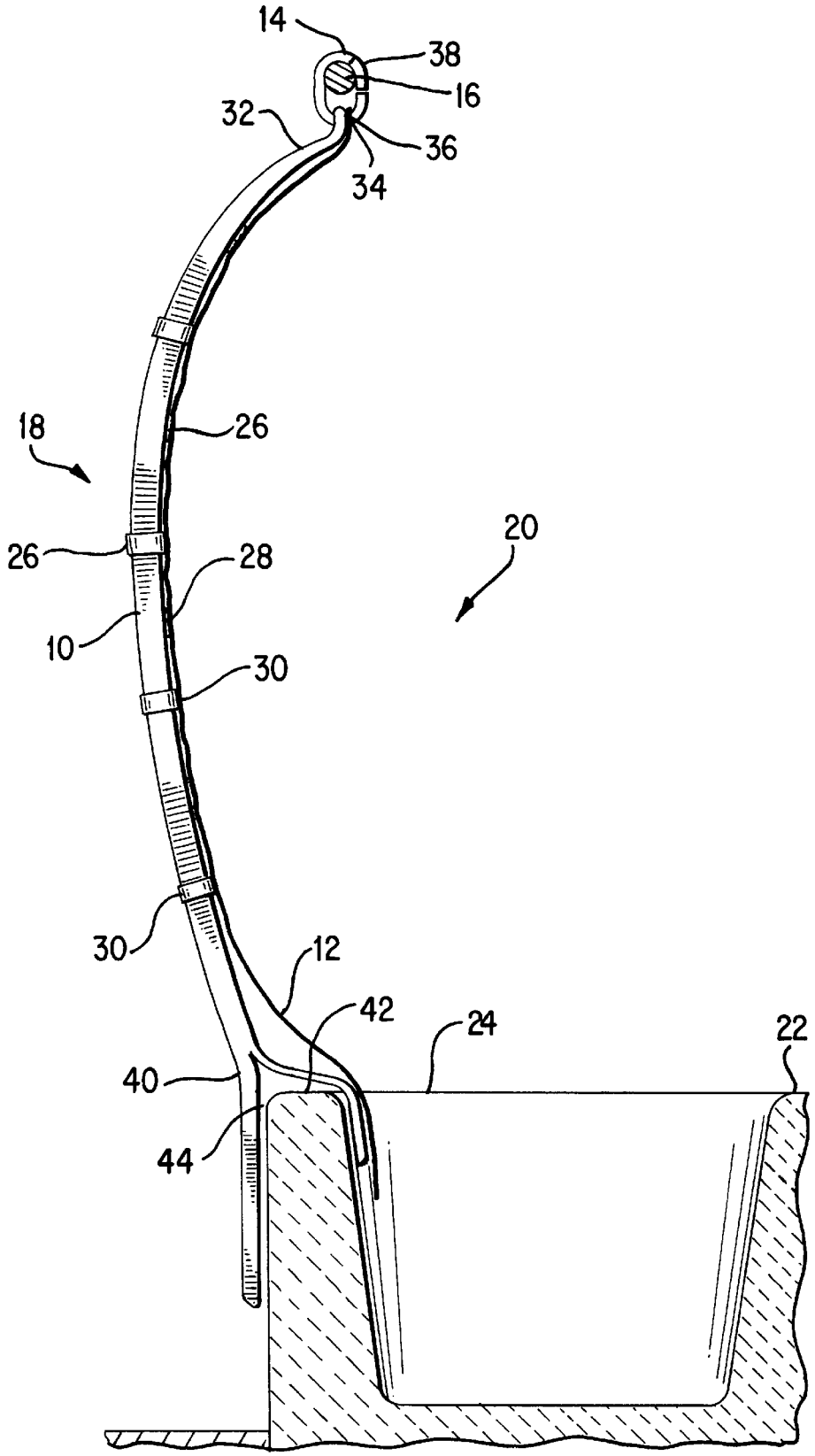
FIG. 2 shows a side view of a single shower curtain rib of the present invention as employed in FIG. 1.

The ribs 10 are designed for use with regular, commercially available shower curtains 12 that are modified with an attachment means 26, which may be either Velcro® brand hook and loop patches 28 or plastic loops or ties 30, as shown in FIG. 2, which are glued to the curtain 12 at the proper places. Alternatively, the ribs 10 of the present invention may be used with specially designed curtains that are manufactured with either the Velcro® patches 28 or plastic loops or ties 30 already affixed to them. For shower curtains 12 with the plastic loops or ties 30 attached, the ribs 10 are placed through the plastic loops attached to the shower curtain, or the ties are bound to the ribs 10. For shower curtains 12 and ribs 10 with the Velcro® patches 28 glued to them, the Velcro® patches 28 glued to the shower curtain 12 are attached to the corresponding Velcro® patches 28 glued to the ribs 10 at the right places. Loops 30 of the variety envisioned in the present invention are shown in FIG. 2, and the Velcro® patches 28 are illustrated in both FIGS. 1 and 2.

Arrangement of Ribs

The upper end 32 of each rib 10 is provided with a first curtain rod attachment means 34 to permit attachment to a curtain rod 16, either individually, or in combination with a shower curtain 12. In the embodiment illustrated in FIGS. 1 and 2, this first curtain rod attachment means 34 has a hole 36 through it that allows the rib 10 to be hung from the curtain rod 16 on a shower curtain ring 38, and positioned outside of the inner, plastic shower curtain 12. The lower end 40 of the rib 10 is held in place along the upper periphery 42 of the bathtub/shower 24 or lip on the floor of the shower stall, by any of several attachment means 44 illustrated in the Drawings. To be serviceable in this regard, such an attachment means 44 should prevent the lower end 40 of the rib 10 from moving inward or outward.

Figure 4:
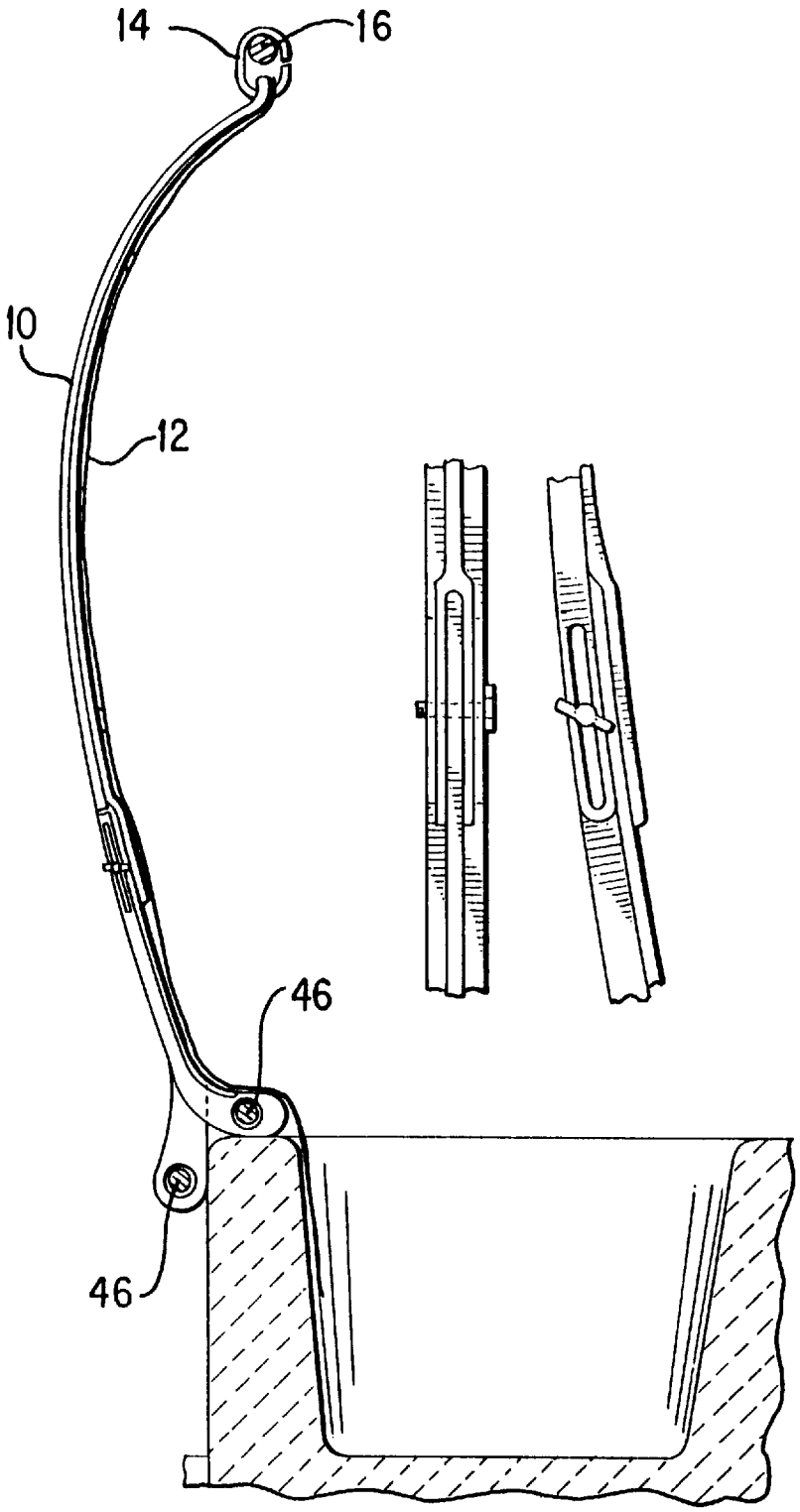
FIG. 4 shows a side view of an alternative embodiment of the device of the present invention.

As illustrated in FIG. 4, the ribs 10 could be made adjustable in length to adjust to the differing heights of an access opening 18, between the curtain rod 16 and the upper periphery 42 of the bathtub 22 or the top of the raised lip on the floor of the shower stall.

Use of these components in this manner will keep the shower curtain 12 away and out of the showering area 20. At the same time, the shower curtain 12 may be opened in the usual manner by pushing the shower curtain 12 and ribs 10 together aside from the opening 18 of the bathtub 24 or shower stall or closed by pushing the curtain 12 and ribs 10 together across this opening 18.

Measurements

No measurements are shown in the attached Drawings, and one skilled in this art will recognize that the present device can be varied to take into account the different sizes of bathtub/showers and shower stalls. It is envisioned that six to eight ribs may be used for bathtub/showers and four to six ribs may be used for shower stalls.

First Embodiment

Figure 3:
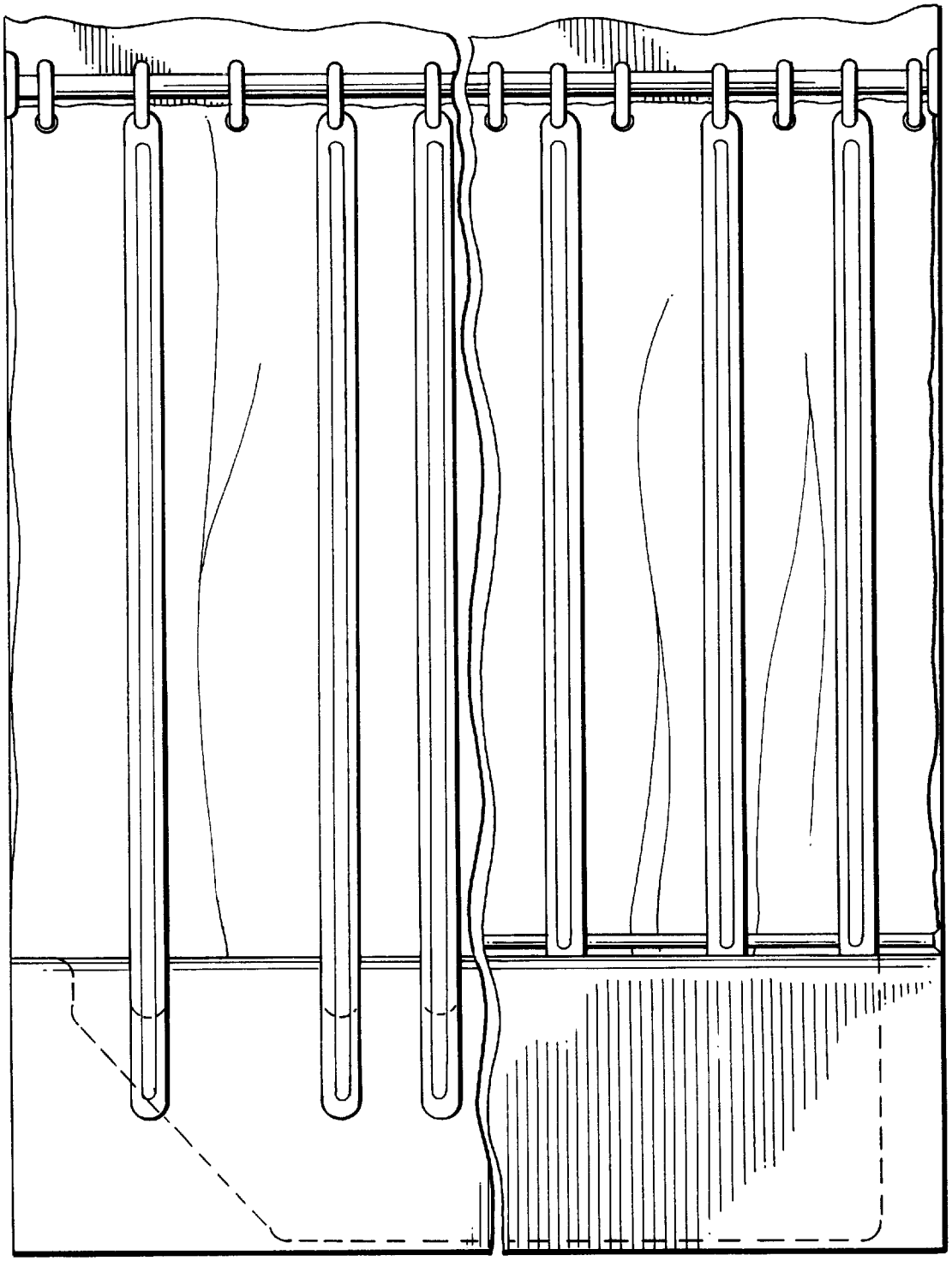
FIG. 3 shows a planar view of the shower arrangement of FIG. 1, from outside the shower enclosure.

A first embodiment of the present invention is shown in FIGS. 1 to 3. This embodiment is intended for bathtub/showers and shower stalls that have a raised lip along the floor on the open side of the shower stall. In this embodiment, each rib 10 is held in place at the bottom by an inner stay and outer stay that saddle the brim of the bathtub or the raised lip on the floor of the shower stall on the open side. The inner stay runs down into the bathtub or inside the shower stall lip while the outer stay runs down the outside of the bathtub or shower stall lip. The stays should be either in or out and there should be enough play between each stay and the bathtub brim or shower stall lip to allow the ribs to be moved back and forth along the bathtub brim or shower stall lip as the shower curtain is opened and closed, but not too much play between each stay and the bathtub brim/shower stall lip that would permit the ribs to turn on the vertical axis so that the bowing would not be at or close to right angles to the side of the tub. Once the ribs and curtain are moved across the opening, the ribs are kept from moving inward into the showering area or outward away from the bathtub by the stays.

Second Embodiment

A second embodiment of the present invention is shown in FIGS. 3 to 6. This embodiment is intended for bathtub/showers and shower stalls that have a raised lip along the floor (on the open side of the shower stall). In this second embodiment, each rib 10 is held in place at the bottom by a second shower curtain rod 46 that is attached to a bracket at either end of the rod. The brackets are attached to the side of the bathtub or shower stall lip on the outside of the bathtub or lip so that the lower shower curtain rod 46 runs along just below the brim of the bathtub or shower stall lip on the outside (on the open side of the bathtub or shower stall) and runs parallel to the upper shower curtain rod 16. In this embodiment, each rib 10 has a hole 48 at the lower end 40 of the rib 10 that is large enough for the lower curtain rod 46 to run through the rib 10, as shown in the FIGS. 4 to 6. In another embodiment, which is not shown, the lower end 40 of each rib 10 could be shortened and have a hole in it that is large enough for a regular shower curtain ring to fit through. The lower shower curtain rod 46 could be passed through the ring so that the lower end of the rib 10 is attached by the ring to the lower shower curtain rod 46 in the same way that the upper end 32 of the rib 10 is attached to the upper shower curtain rod 16. In either of these two embodiments, the lower end 40 of each rib 10 can run along the lower shower curtain rod 46 so that the ribs 10 and shower curtain 12 may be pushed aside or across the opening 18 freely while the ribs 10 are kept from moving inward into the showering area 20 or outward away from the bathtub or shower stall 24 by the lower shower curtain rod 46.

Figure 5:
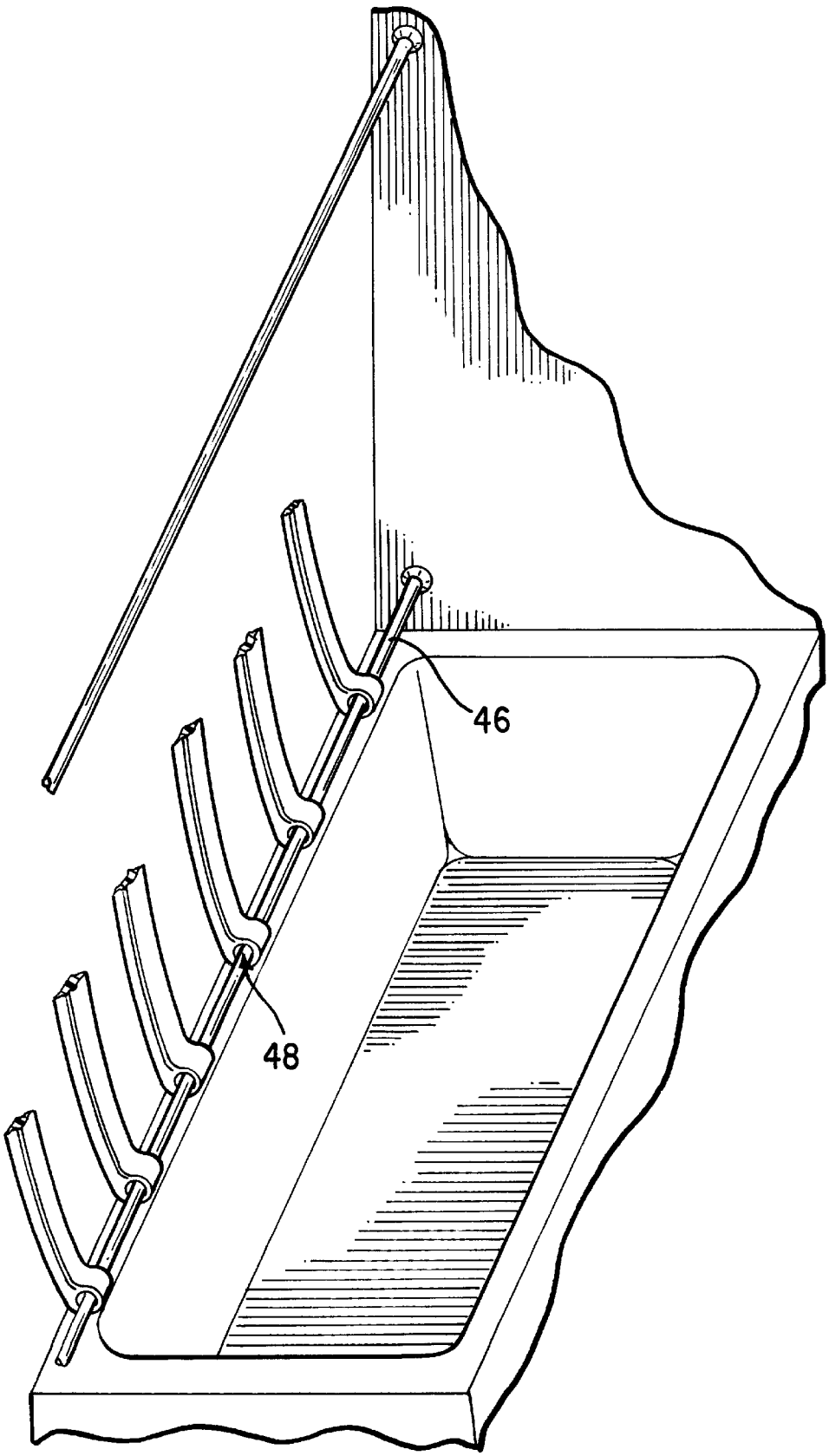
FIG. 5 shows a perspective view of a typical shower arrangement installed in a bathtub, with a plurality of shower curtain ribs of FIG. 4.
Figure 6:
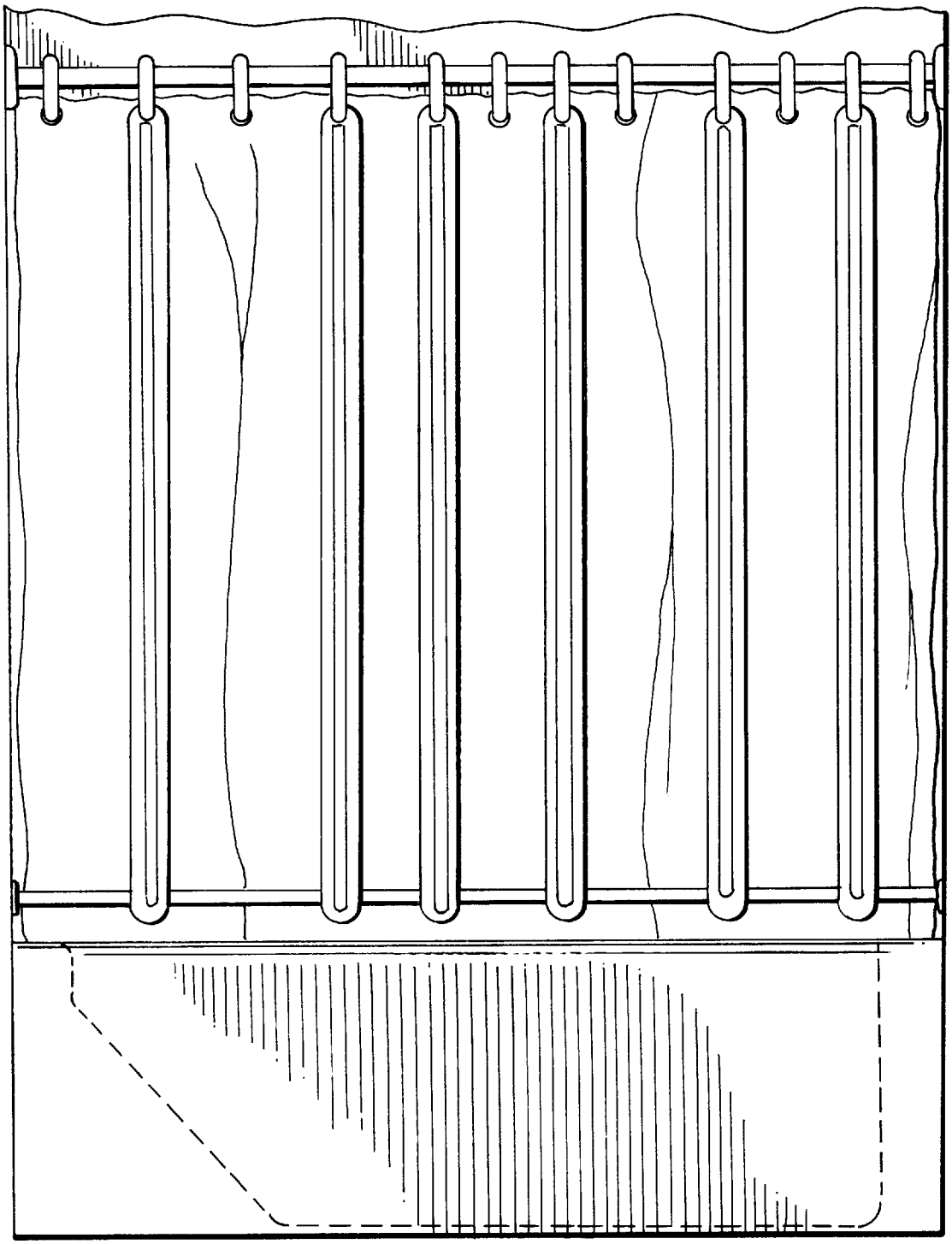
FIG. 6 shows a planar view of the shower arrangement of FIG. 5, from outside the shower enclosure.

A variation of the present invention is shown in FIGS. 3 to 5. This variation is also intended for bathtub/showers and shower stalls that have a raised lip along the floor (on the open side of the shower stall). In this variation on the second embodiment, as described above, each rib 10 is held in place at the bottom by a second lower shower curtain rod 46 that is attached to a bracket at either end of the rod 46. In this variation, however, the brackets are attached to the wall on either end of the bathtub or shower stall lip just above the brim of the bathtub or shower stall lip (on the open side of the bathtub or shower stall) so that the lower shower curtain rod 46 runs along just above and level with the brim of the bathtub or shower stall lip (on the open side of the bathtub or shower stall) and runs parallel to the upper shower curtain rod 16. Each rib 10 has a hole 48 at the lower end 40 of the rib 10 that is large enough for the lower curtain rod 46 to run through the rib 10, as shown in FIG. 5. In an alternative variation, not shown in the Drawings, the lower end 40 of each rib 10 could be slightly shorter and have a hole in it that is large enough for a commercially available shower curtain ring to go through it. The lower shower curtain rod 46 could be passed through the ring so that the lower end of the rib 40 is attached by the ring to the lower shower curtain rod 46 in the same way that the upper end of the rib 32 is attached to the upper shower curtain rod 16. In either of these two variations, the lower ends 40 of the ribs 10 can run along the lower shower curtain rod 46 so that the ribs 10 and shower curtain 12 may be pushed aside or across the opening 18 freely while the ribs 10 are kept from moving inward into the showering area 20 or outward away from the bathtub or shower stall 24 by the lower shower curtain rod 46.

Third Embodiment

Figure 8:
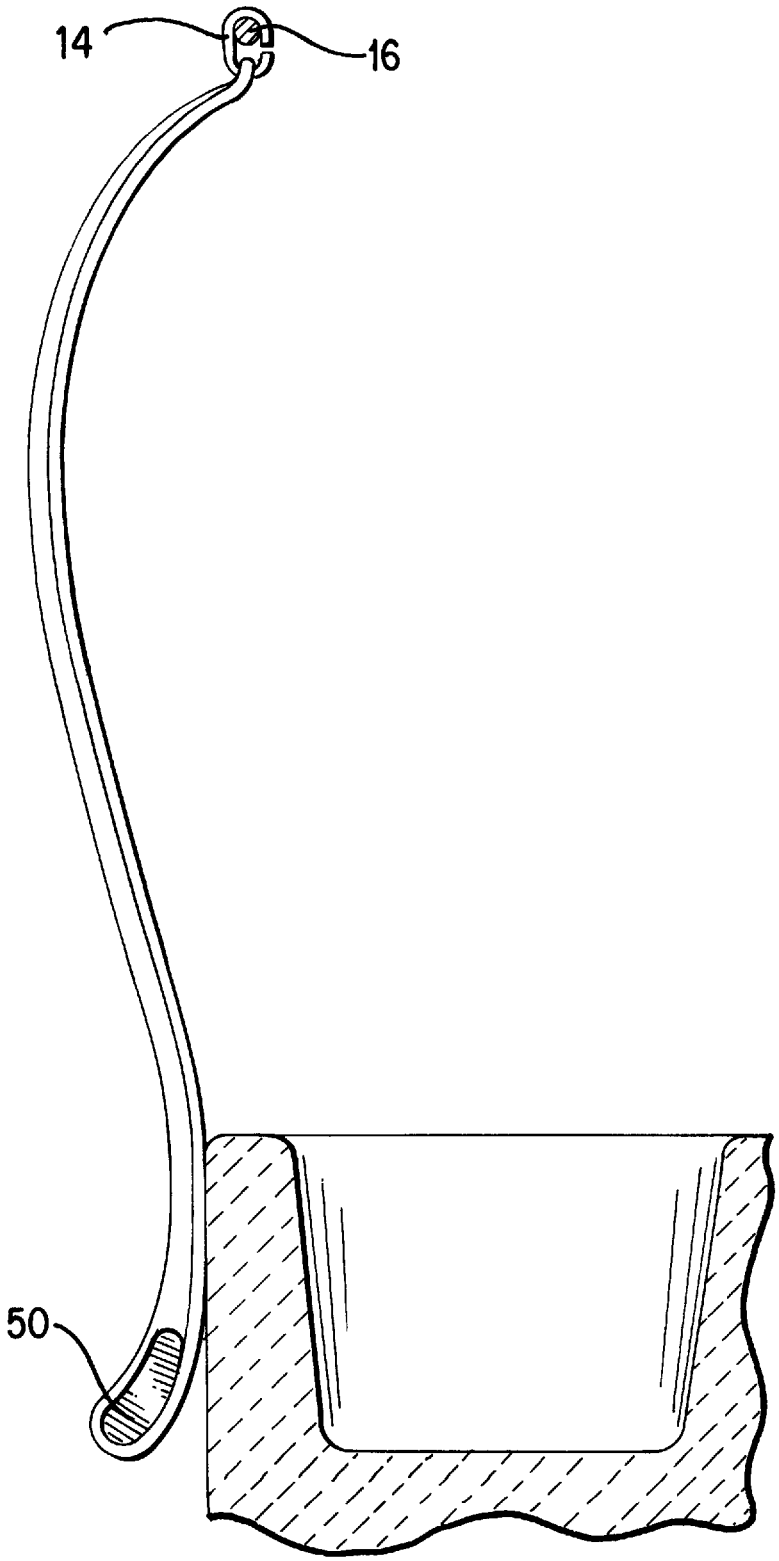
FIG. 8 shows a side view of an alternative embodiment of the device of the present invention.
Figure 9:
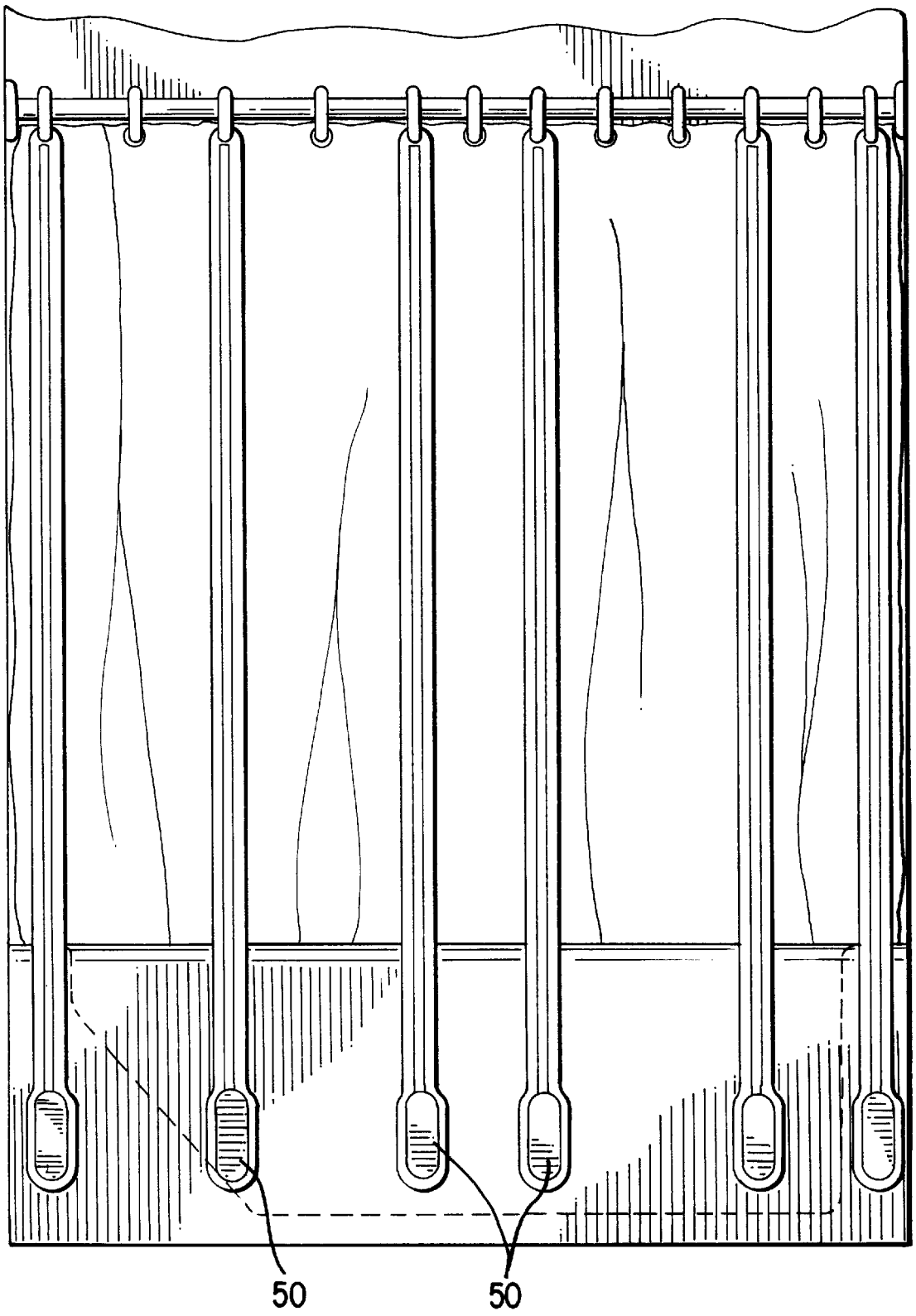
FIG. 9 shows a planar view of the shower arrangement of FIG. 8, from outside the shower enclosure.
Figure 10A:
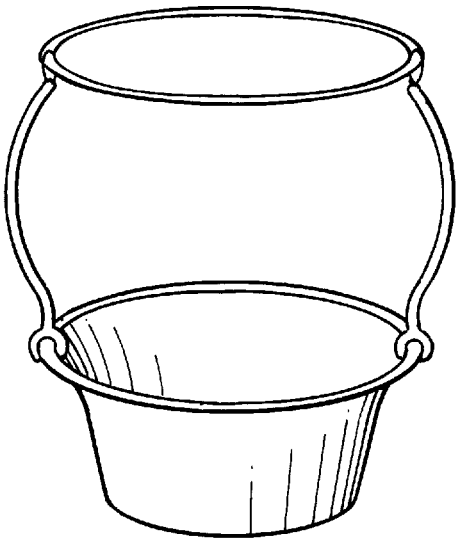
Figure 10B:
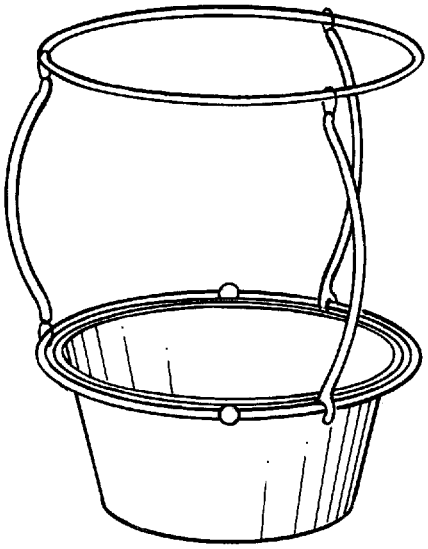
Figure 10C:
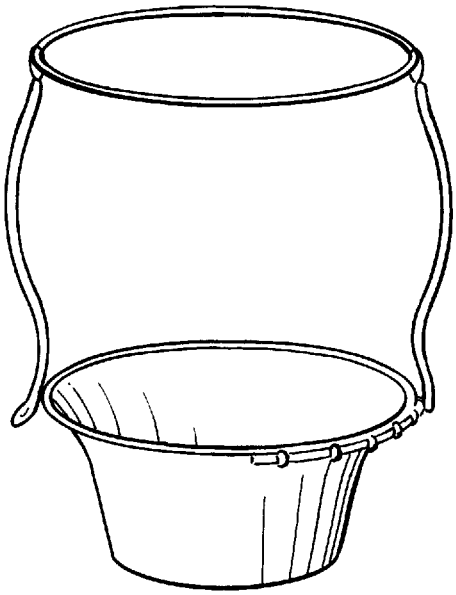
Figure 10D:
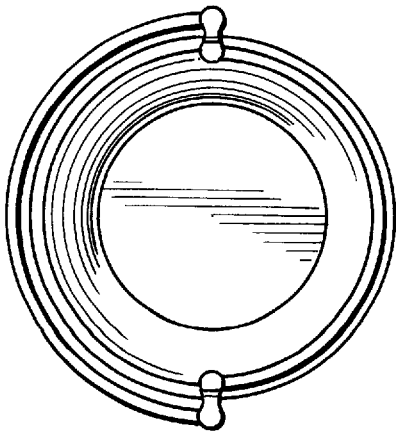

A third major embodiment is shown in FIGS. 8 and 9. This embodiment is intended for bathtub/showers and shower stalls that have a raised lip along the floor on the open side of the shower stall. In this third embodiment, each rib 10 is held in place at its lower end 40 by a weight 50 that is attached to or imbedded into the lower end 40 of the rib 10 and that is preferably angled outward from the bathtub or shower stall 24. The rib 10 is long enough to run down the outside of the side of the bathtub or shower stall lip. Because the weight 50 is angled outward, it presses the lower end 40 of the rib 10 downward and sideways inward and against the outside of the side of the bathtub or shower stall lip. This arrangement allows the ribs 10 and curtain 12 to be moved together back and forth along the side of the bathtub or lip of the shower stall (on the open side of the bathtub or shower stall) as the shower curtain 12 is opened and closed. Once the ribs 10 and curtain 12 are moved across the opening 18, the ribs 10 are kept from moving inward into the showering area 20, because the lower end 40 of the ribs 10 are outside of and below the bathtub brim or shower stall lip, and the ribs are kept from moving outward away from the bathtub or shower stall by the weights 50 attached to the lower ends 40 of the ribs 10.

Figure 7:
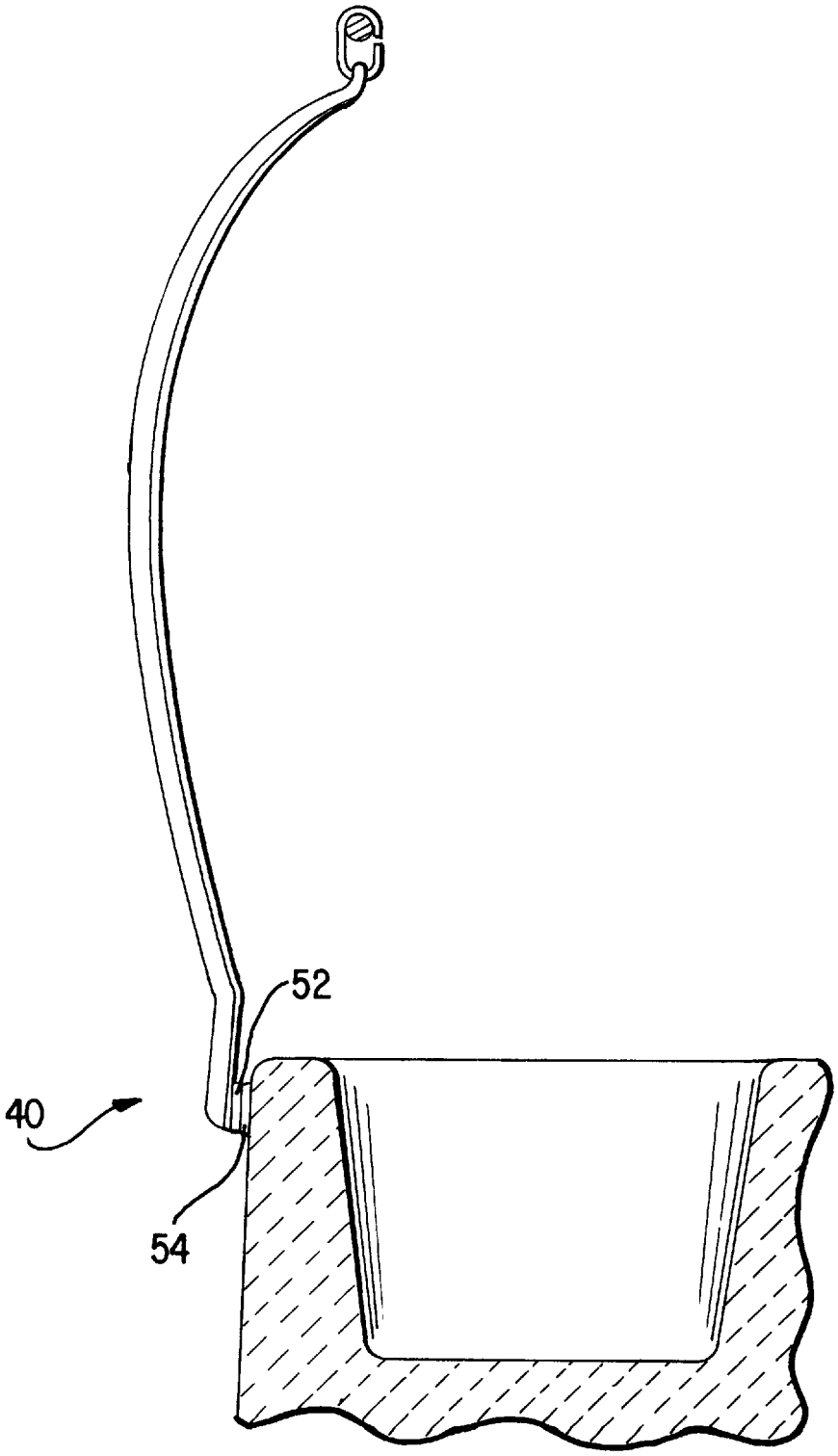
FIG. 7 shows a side view of an alternative embodiment of the device of the present invention.

Another variation of this embodiment is shown in FIG. 7. This variation is also intended for bathtub/showers and shower stalls that have a raised lip along the floor on the open side of the shower stall. In this variation, each rib 10 is held in place at its lower end 40 by a magnet 52 that is glued or imbedded in the lower end 40 of the rib 10. If the bathtub or shower stall lip is not itself magnetic, at intervals along the outside of the bathtub or shower stall lip, on the open side of the bathtub or shower stall, and near and parallel to the brim of the bathtub or shower stall lip, magnets 54, or metal pieces 54 that magnets would adhere to, would be glued. In this regard, it might prove convenient to provide the magnets 54 or metal pieces 54 attached to a plastic strip, so that they are appropriately spaced for the purpose of gluing them to the side of the bathtub and once glued in place the plastic strip could remain or be removed and discarded. Alternatively, instead of the magnets or metal pieces, a metal strip 55 that magnets will adhere to, or a metalized or magnetized plastic strip could be supplied and glued to the outside of the bathtub or shower stall lip near and parallel to the bathtub brim or shower stall lip. This latter alternative has the advantages that (1) the magnet 52 in the lower end 40 of the rib 10 can adhere magnetically at any point along the side of the bathtub or shower stall lip rather than at just the places where the magnets or metal pieces would otherwise be glued and (2) the magnets or metal pieces do not have to be properly spaced for gluing along the outside of the bathtub or shower stall lip. In either of these two variations, the lower ends 40 of the ribs 10 can be moved along the outside of the bathtub or shower stall lip by detaching the magnets 52 in the lower ends 40 of the ribs 10 from the magnets 54, metal pieces, metal strip 55 or magnetized plastic strip, as the case may be, that are glued to the outside of the bathtub or shower stall lip so that the ribs 10 and shower curtain may be pushed aside or across the opening 18 freely. Once the ribs 10 are moved across the opening to close the shower curtain, the magnets 52 in the lower ends 40 of the ribs 10 adhere magnetically to the magnets 54, metal pieces, metal strip 55 or magnetized plastic strip, as the case may be, that are glued to the outside of the bathtub or shower stall lip, the ribs 10 are kept from moving inward into the showering area 20, because the lower ends 40 of the ribs 10 are outside of and below the bathtub brim or shower stall lip, and the ribs are kept from moving outward away from the bathtub 24 by the adherence of the magnets. Other Variations One skilled in the art will recognize that the basic embodiments previously discussed can be employed in other bath/shower environments. In particular, as illustrated in FIGS. 10*a* to 10*d*, the present invention can be employed with circular bathtubs or shower stalls. Several variations of such a device are shown which may be used for circular as well as regular non-circular bathtubs or shower stalls so long as, for the circular shower stall, it has a circular lip around the floor of the stall that is raised enough to be used for these variations. Assuming the upper shower curtain rod is attached in a way that permits the shower curtain rings to move freely all the way around the bathtub or shower stall, a single curtain and an appropriate number of ribs may be used all the way around the circular bathtub or shower stall for all variations, except for the variations shown in FIGS. 10*b* and FIG. 10*d*, which require a lower circular curtain rod. For these variations, if it is desired that the shower curtain be opened up all the way around, a minimum of two shower curtains, each of which extends around its half of the circular bathtub or shower stall would be needed because the lower circular shower curtain rods would need to be supported by brackets at at least two points, opposite one another on opposite sides of the bathtub or shower stall. The second bracket would prevent the lower ends of the ribs from moving around beyond the bracket, whether the lower end of the rib itself has a hole in it for the rod to pass through or a lower shower curtain ring is used to attach the lower end of the rib to the lower shower curtain rod. By using two semi-circular lower shower curtain rods, two curtains and two sets of ribs, the curtains and ribs may be pushed aside and around in both directions away from one bracket and from one another to open the curtain up all the way around the circular bathtub or shower stall at the other bracket. In the alternative, if only one side of the circular bathtub or shower stall needs to be opened, the other side can be left permanently closed around one half of the bathtub or shower stall, and the ribs and curtain on the side that is opened and closed may be moved around from one bracket to the other halfway around the circular bathtub or shower stall. For this alternative, a single curtain may be used and the ribs on the side that is left closed permanently do not need to be moved at all and do not need to slide around past the second bracket.

Figure 11A:
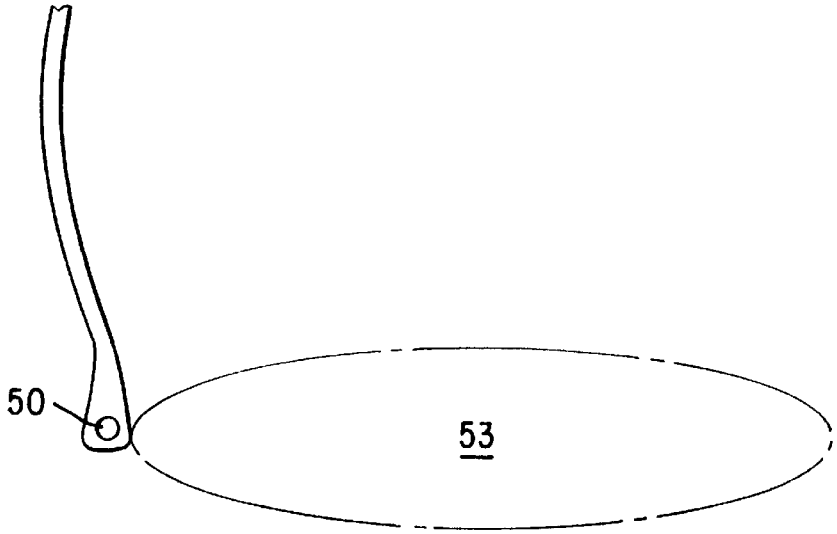
FIGS. 11*a* and *b* show alternative embodiments of the present invention employed with circular shower stall designs.
Figure 11B:
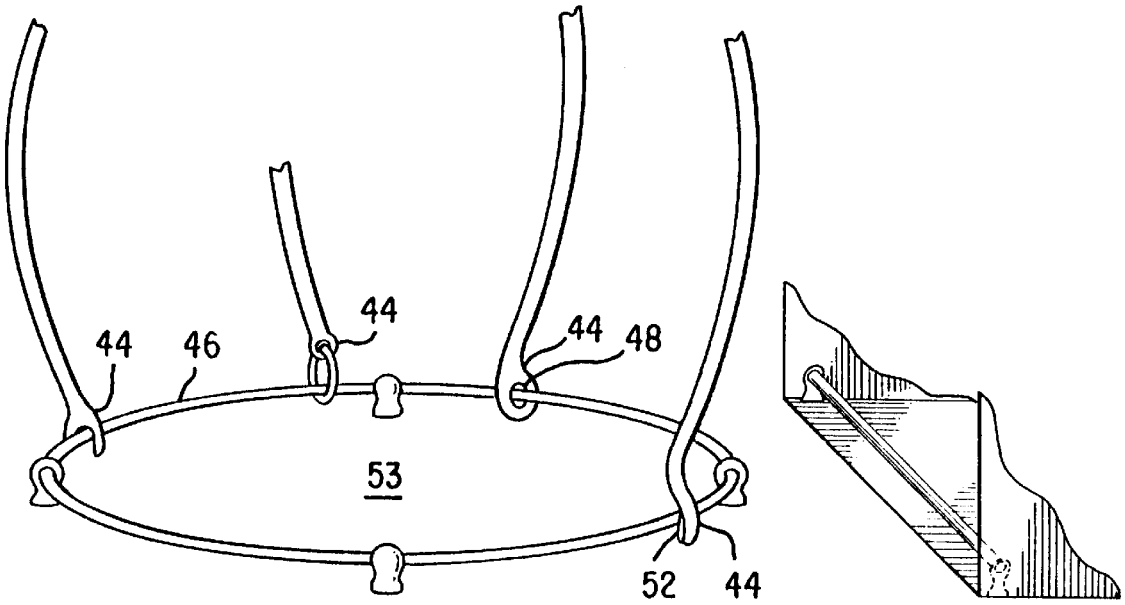

For shower stalls that do not have a raised lip on the floor across the opening, and for circular stalls that do not have a raised lip around the floor, the use of a variation with an internal weight is believed appropriate. A variation believed to be particularly suited for shower stalls that do not have a raised lip is shown in FIG. 11*a*. The weights 50 at the lower ends of the ribs could be made so that they are not angled and are flat on the bottom so that the weights would rest flat against the floor, adding friction against the floor to the force of the weights themselves to keep the lower ends of the ribs from moving inward or outward. The other variations discussed above could be used, of course, if a lower shower curtain rod were attached along the floor at the opening to a three-walled shower stall or around the floor of a circular shower stall, as shown in FIG. 11*b*. The lower shower curtain rod could be made available with brackets that could be either screwed or glued in place. For one variation, the lower shower curtain rod would serve as a brim or lip for the inner and outer stays to saddle. Alternatively, for other variations, the lower shower curtain rod would be used as described above in those variations. Finally, for a variation that has the magnets attached at the lower ends of the ribs, the lower shower curtain rod could be made of a metal that magnets adhere to or have a magnetized plastic strip running along the outside of the rod so that the magnets on the lower ends of the ribs would adhere to the lower shower curtain rod.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An apparatus for use with a shower curtain, which shower curtain is capable of effectively closing off an opening of a shower enclosure to contain a shower spray within said shower enclosure, said opening having an upper periphery provided with a curtain rod from which said shower curtain is suspended, and a lower periphery within which said shower curtain is intended to remain, the apparatus comprising:

a plurality of semi-rigid ribs movable positioned along said shower enclosure opening;

means for suspension of said ribs from said curtain rod at the upper periphery of said opening;

a lower end of each rib having; an inverted U-shaped stabilizer having inner and outer stays that saddle said lower periphery; for operatively engaging said lower periphery and, attachment means to operatively engage said ribs with said shower curtain and prevent movement of said shower curtain inward from said ribs into said shower enclosure.

2. The apparatus of claim 1 further defined in that each said rib may be adjusted in vertical length to accommodate different sized shower enclosure openings.

3. The apparatus of claim 1 further defined in that each rib bows outward from said shower enclosure along the length of said rib.

4. The apparatus of claim 3 further defined in that each said rib may be adjusted in length to accommodate a different degree of bowing.

5. The apparatus of claim 1 wherein said means for suspension of said ribs comprises shower curtain hooks.

6. The apparatus of claim 5 wherein said shower curtain is also adapted to be suspended from said shower curtain hooks.

7. The apparatus of claim 1 wherein said inner and outer stays engage an inside edge and an outside edge of said lower periphery of said opening.

8. The apparatus of claim 1 wherein said shower enclosure is a bathtub equipped with a shower.

9. The apparatus of claim 1 wherein said shower enclosure is a shower stall.

10. An apparatus for the creation and maintenance of a larger open space inside a shower enclosure having a shower curtain, which apparatus comprises:

i) a shower enclosure of generally box-like configuration with an upper periphery which is open and a closed lower periphery, said enclosure having:

at least one raised shower head located near the upper periphery of said enclosure, said shower head capable of providing a spray of water within said shower enclosure;

a base at the lower periphery of said shower enclosure for the purpose of collecting and draining away water from said shower head; and, at least one open area for entrance and egress by a user, said open area defined, at least in part, by an upper periphery of said base;

ii) a curtain rod positioned near the upper periphery of said shower enclosure and provided with a first curtain rod attachment means from which a shower curtain may be suspended;

iii) a shower curtain of flexible material suspended from said curtain rod by said first curtain rod attachment means and capable of effectively closing off said open upper periphery to contain said spray of water within said shower enclosure;

iv) a plurality of semi-rigid shower curtain ribs movably positioned along said open upper periphery, and descending vertically from said curtain rod to a point beyond the upper periphery of said base, each of said ribs having:

a second curtain rod attachment means at its upper periphery, said second curtain rod attachment means engagedly attached to said curtain rod;

an inverted U-shaped fork of two tines at its lower terminal end, which fork engages said upper periphery of said base with one tine of said fork within said shower enclosure and the other tine of said fork outside said shower enclosure;

first curtain attachment means joining said shower curtain to said ribs at at least one point along the vertical length of each said rib, and preventing movement of said shower curtain inward from said rib into said shower enclosure.

11. An apparatus for the creation and maintenance of a larger open space inside a shower enclosure having a shower curtain, which apparatus comprises:

i) a shower enclosure of generally box-like configuration with an upper periphery which is open and a closed lower periphery, said enclosure having:

at least one raised shower head located near the upper periphery of said enclosure, said shower head capable of providing a spray of water within said shower enclosure;

a base at the lower periphery of said shower enclosure for the purpose of collecting and draining away water from said shower head; and, at least one open area for entrance and egress by a user, said open area defined, at least in part, by an upper periphery of said base;

ii) a curtain rod positioned near the upper periphery of said shower enclosure and provided with a first curtain rod attachment means from which a shower curtain may be suspended;

iii) a shower curtain of flexible material suspended from said curtain rod by said first curtain rod attachment means and capable of effectively closing off said open upper periphery to contain said spray of water within said shower enclosure;

iv) a plurality of semi-rigid shower curtain ribs movably positioned along said open upper periphery, and descending vertically from said curtain rod to a point proximate to the upper periphery of said base defining said open area, each of said ribs having:

a second curtain rod attachment means at its upper periphery, said second curtain rod attachment means engagedly attached to said curtain rod;

an inverted U-shaped stabilizing means at its lower terminal end, having an inner stay and an outer stay said stays of the stabilizing means engaging said upper periphery of said base and positioning said ribs relative thereto;

first curtain attachment means joining said shower curtain to said rib at at least one point along the vertical length of said rib, and preventing movement of said shower curtain inward from said rib into said shower enclosure.

* * * * *